US009266006B2

(12) United States Patent
Herold

(10) Patent No.: US 9,266,006 B2
(45) Date of Patent: Feb. 23, 2016

(54) ATHLETIC PACE SIGNALING SYSTEM AND METHOD

(71) Applicant: Jeffrey A. Herold, Kohler, WI (US)

(72) Inventor: Jeffrey A. Herold, Kohler, WI (US)

( * ) Notice: Subject to any disclaimer, the term of this patent is extended or adjusted under 35 U.S.C. 154(b) by 0 days.

(21) Appl. No.: 14/489,067

(22) Filed: Sep. 17, 2014

(65) Prior Publication Data

US 2015/0087477 A1 Mar. 26, 2015

Related U.S. Application Data

(60) Provisional application No. 61/880,489, filed on Sep. 20, 2013.

(51) Int. Cl.

| | |
|---|---|
| ***A63B 71/00*** | (2006.01) |
| ***A63B 71/06*** | (2006.01) |
| ***A63B 69/00*** | (2006.01) |
| ***A63B 69/12*** | (2006.01) |

(52) U.S. Cl.

CPC ..... *A63B 71/0686* (2013.01); *A63B 69/0028* (2013.01); *A63B 69/12* (2013.01); *A63B 2207/02* (2013.01); *A63B 2220/13* (2013.01); *A63B 2225/093* (2013.01); *A63B 2225/20* (2013.01); *A63B 2225/50* (2013.01)

(58) Field of Classification Search

CPC ..... A63B 71/0686; A63B 69/0028; A63B 69/12; A63B 2207/02; A63B 2220/13; A63B 2225/093; A63B 2225/20; A63B 2225/50

See application file for complete search history.

(56) References Cited

U.S. PATENT DOCUMENTS

| | | | | |
|---|---|---|---|---|
| 4,309,599 | A | 1/1982 | Myers | |
| 4,518,266 | A | 5/1985 | Dawley | |
| 4,932,045 | A | 6/1990 | Kasoff et al. | |
| 4,993,004 | A | 2/1991 | Loizeaux | |
| 5,063,285 | A | 11/1991 | Curry | |
| 5,285,428 | A | 2/1994 | Rosow et al. | |
| 5,325,340 | A * | 6/1994 | Ramsey | 368/3 |
| 5,767,417 | A | 6/1998 | Parris et al. | |
| 6,033,228 | A | 3/2000 | Ladin | |
| 6,086,379 | A | 7/2000 | Pendergast et al. | |
| 6,412,201 | B1 | 7/2002 | Traen | |
| 6,940,784 | B1 | 9/2005 | Benson | |
| 7,029,170 | B2 | 4/2006 | Bailey | |
| 7,449,847 | B2 | 11/2008 | Schanberger et al. | |
| 2007/0200726 | A1 * | 8/2007 | Harvin | 340/815.45 |
| 2010/0304934 | A1 | 12/2010 | Woodson | |
| 2013/0187553 | A1 * | 7/2013 | Cessna | 315/161 |

OTHER PUBLICATIONS

"Pace Lights and Swim Performance," Swimming Technique, Oct.-Dec. 1999, pp. 18-20.

PB Pacer pacing device, known and accessible to the public at least prior to Sep. 20, 2013, as illustrated and described in the accompanying product information, 5 pages.

(Continued)

*Primary Examiner* — Glenn Richman

(74) *Attorney, Agent, or Firm* — Michael Best & Friedrich LLP

(57) ABSTRACT

An athletic pace signaling system includes a plurality of light generating modules and a control assembly in communication with the plurality of light generating modules. The control assembly includes a control circuit configured to store a predetermined pace and to cooperatively control the plurality of light generating modules such that each module projects a light associated with a training pace.

9 Claims, 7 Drawing Sheets

(56) References Cited

OTHER PUBLICATIONS

Sport Count Combo Lap Counter, known and accessible to the public at least prior to Sep. 20, 2013, as illustrated and described in the accompanying product information, 1 page.

Finis Lap Track, known and accessible to the public at least prior to Sep. 20, 2013, as illustrated and described in the accompanying product information, 1 page.

Swimovate PMG Pool Mate Computer Sports Watch, known and accessible to the public at least prior to Sep. 20, 2013, as illustrated and described in the accompanying product information, 1 page.

Pyle PSLPWMP5 Waterproof Pedometer & Lap/Calorie Counter with MP3 Player, known and accessible to the public at least prior to Sep. 20, 2013, as illustrated and described in the accompanying product information, 1 page.

SpeedoSpeedo Unisex SD55143BX Ani-Digi Lap Counter Silicone Strap Watch, known and accessible to the public at least prior to Sep. 20, 2013, as illustrated and described in the accompanying product information, 1 page.

* cited by examiner

ATHLETIC PACE SIGNALING SYSTEM AND METHOD

BACKGROUND

The present invention relates to signaling systems, and more particularly to athletic pace signaling systems.

SUMMARY

An athletic pace signaling system includes a plurality of light generating modules and a control assembly in communication with the plurality of light generating modules. The control assembly includes a control circuit configured to store a predetermined pace and to cooperatively control the plurality of light generating modules such that each module projects a light associated with a training pace.

An athletic pace signaling system includes a plurality of light generating modules. Each light generating module has a housing, a support member extending from the housing, an arm pivotally coupled to the support member and defining a cavity having an opening, and a light generating source positioned to project a light through the opening. The system also includes a control unit couplable to the plurality of light generating modules. The control unit has a controller coupled to memory, a communication interface in communication with the memory, and a user interface in communication with the controller. The controller is configured to store a predetermined pace and to cooperatively control the plurality of light generating modules to sequentially generate light representative of the predetermined pace.

A method of indicating a training parameter to an individual training for athletic or recreational events includes a step of storing the training parameter within the memory of a controller couplable to a plurality of separable light generating modules. The method also includes a step of selectively activating the plurality of light generating modules to represent the training parameter. The activating projects a light to a surface viewable by the individual.

A method of assisting a swimmer with pool training includes a step of receiving a predetermined swimming pace within memory of a controller. The controller is couplable to a plurality of light generating modules positioned adjacent the edge of the pool. The method also includes a step of signaling the plurality of light generating modules to sequentially operate based on the predetermined pace. The method further includes a step of generating a plurality of images in response to the signaling. The images are directed to a bottom surface of the pool.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
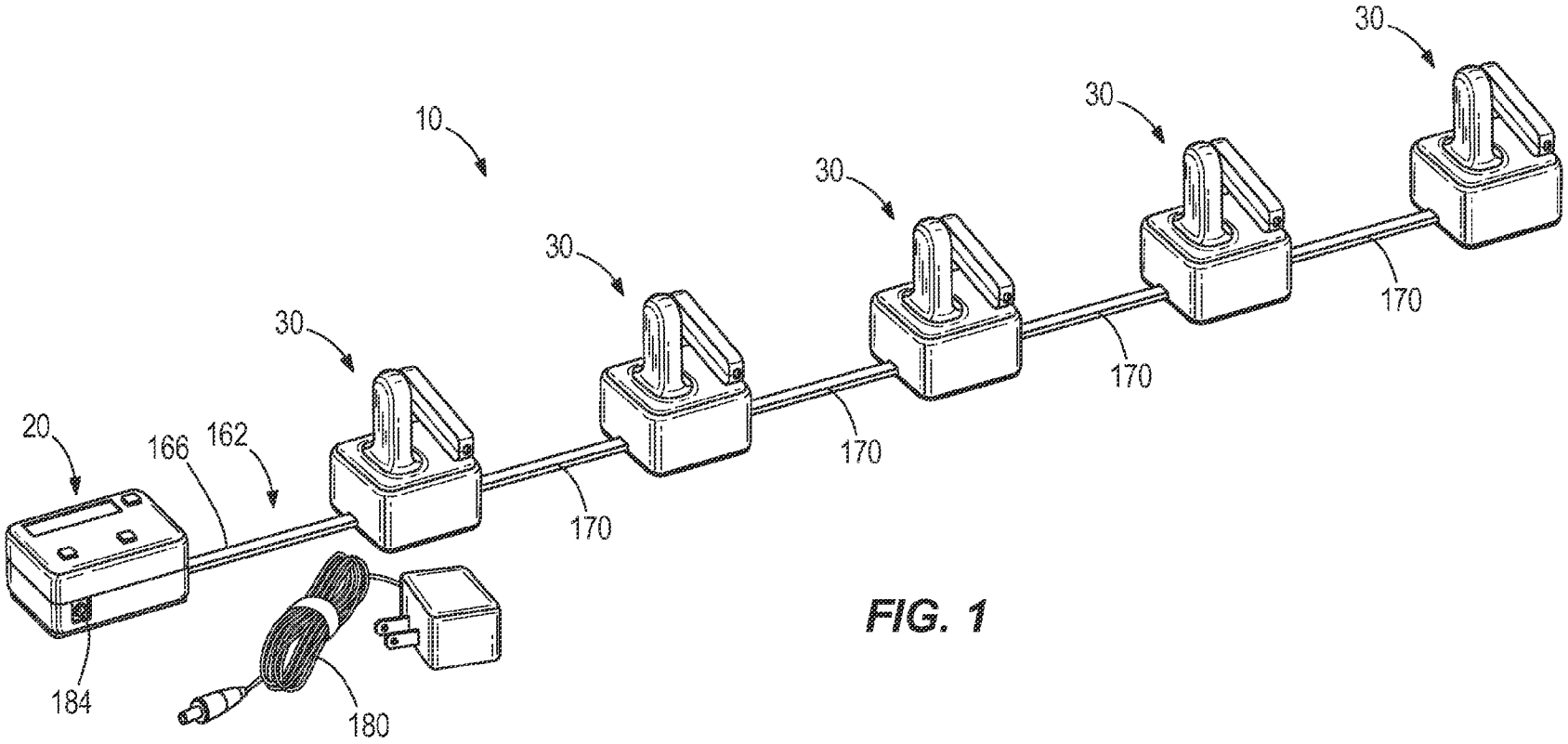
FIG. 1 is a perspective view of an athletic pace signaling system according to an embodiment of the invention.

FIG. 1 illustrates an athletic pace signaling system 10 suitable for indicating a predetermined athletic pace to a user, including an athlete, a coach, or a spectator. As used herein, the term "pace" is defined as a target position of an athlete as a function of time, in the context of athletic training (e.g., for a race). The system 10 includes a control unit 20 and a plurality of light modules 30 in communication with the control unit 20. Although FIG. 1 illustrates five light modules 30, the system 10 can include any number of light modules 30 depending on the athletic event and the training needs of the athlete.

Figure 2:
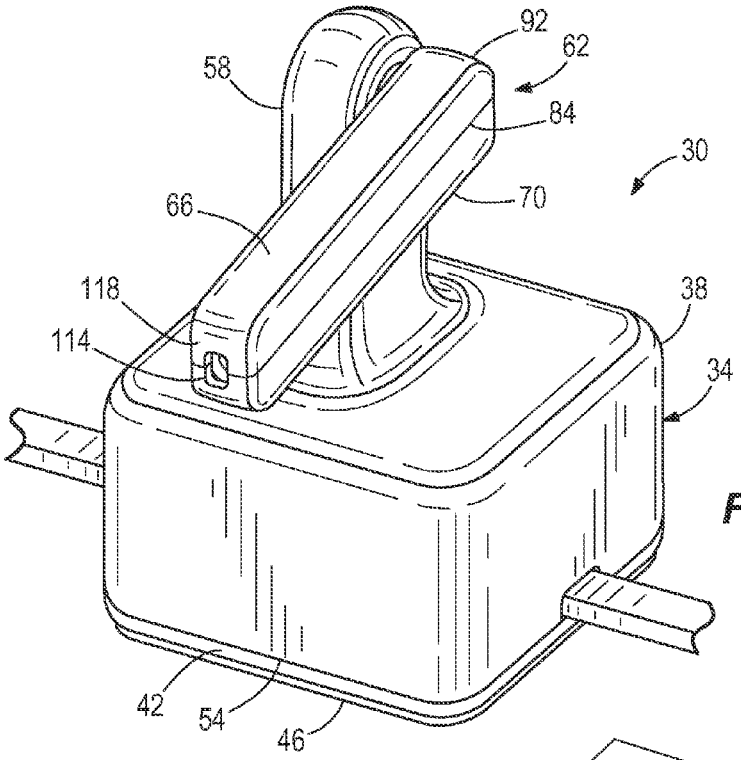
FIG. 2 is a perspective view of a light module of the system of FIG. 1.

Referring to FIG. 2, each light module 30 of the athletic pace signaling system 10 includes a housing 34 having an upper housing portion 38 and a lower housing portion 42. The upper housing portion 38 and the lower housing portion 42 can be coupled together by fasteners, adhesive, a snap fit, a friction fit, or in any other suitable manner. In other embodiments, the housing 34 can be constructed of any number of housing portions in the same or different relative orientations (e.g., lateral housing portions, etc.). A non-slip pad 46 is affixed to a bottom side of the illustrated lower housing portion 42 to provide improved stability when the light module 30 is positioned on a surface. In some embodiments, a seal, lip, or tortuous pathway can be included at an interface 54 between the upper housing portion 38 and the lower housing portion 42 (or other housing portions, as the case may be) to provide water/weather resistance. The housing 34 can be made of high-density polyethylene, and the non-slip pad 46 can be made of die-cut rubber or other elastomer, however, the housing 34 and non-slip pad 46 can be made of any polymeric or other suitable materials.

With continued reference to FIG. 2, a support member, or post 58 extends from the upper housing portion 38. The post 58 can be integrally formed with the upper housing portion 38 or formed separately and thereafter coupled to the upper housing portion 38. In an alternative embodiment, the post 58 can be telescopically or otherwise configured for variable height adjustment above the surface of the upper housing portion 38.

Figure 3:
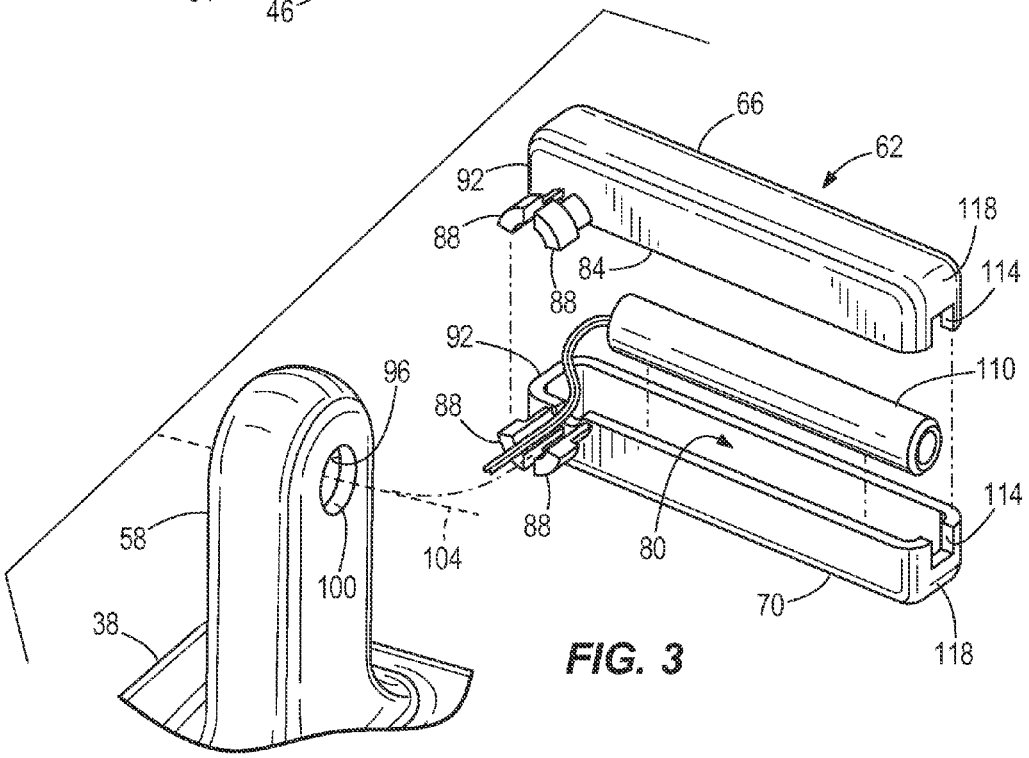
FIG. 3 is an exploded view of a portion of the light module of FIG. 2.

As best illustrated in FIG. 3, an adjustable arm member 62 includes first and second opposing sections 66, 70 that cooperate to define an internal cavity 80. A seal, lip, or tortuous pathway can be included at an interface 84 between the first and second sections 66, 70 to provide water/weather resistance. A pair of arcuate mounting fingers 88 extends laterally from a first end 92 of each of the sections 66, 70. Each of the mounting fingers 88 is engageable with the inner periphery 96 of an aperture 100 located on the post 58 to pivotally couple the arm 62 to the post 58. As such, the arm 62 can be selectively rotated about a pivot axis 104 in order to adjust an orientation of the arm 62. In other embodiments, the arm 62 can be coupled to the post 58 by any other fastener suitable to provide pivotal relative movement between the arm 62 and the post 58. The arm 62 can be infinitely adjustable over a particular angular range. Alternatively, one of the mounting fingers 88 and the inner periphery 96 can be notched or can otherwise have features (e.g., ribs, teeth, elastomeric element providing a compression fit, and the like) to provide set angular positions for the arm 62, or identifiable markings may be included on an arm 62 or post 58 surface in order to provide uniform orientation of each module arm 62.

As shown in FIG. 3, a light generating source 110 is supported within the cavity 80 to project light through an opening 114 formed in a second end 118 of the arm 62. Alternatively, the light source 110 can be supported within the housing 34 to project light through the opening 114 via one or more reflecting mirrors, lenses, and/or other optical devices. In the illustrated embodiment, the light source 110 is a laser (e.g., a laser diode) capable of projecting a narrow, highly-focused beam of light. In other embodiments, the light source 110 can be one or more light-emitting diodes (LEDs). Alternatively, the light source 110 can be a projector capable of producing an image through the opening 114. A lens can be positioned near the opening 114 to further focus or disperse the light emitted by the light source 110, depending on the particular application of the athletic pace signaling system 10. The light source 110 is configured to statically or dynamically project one or more points, lines, alphanumeric characters, shapes, or images onto an athletic surface, as will be further described below.

Figure 4:
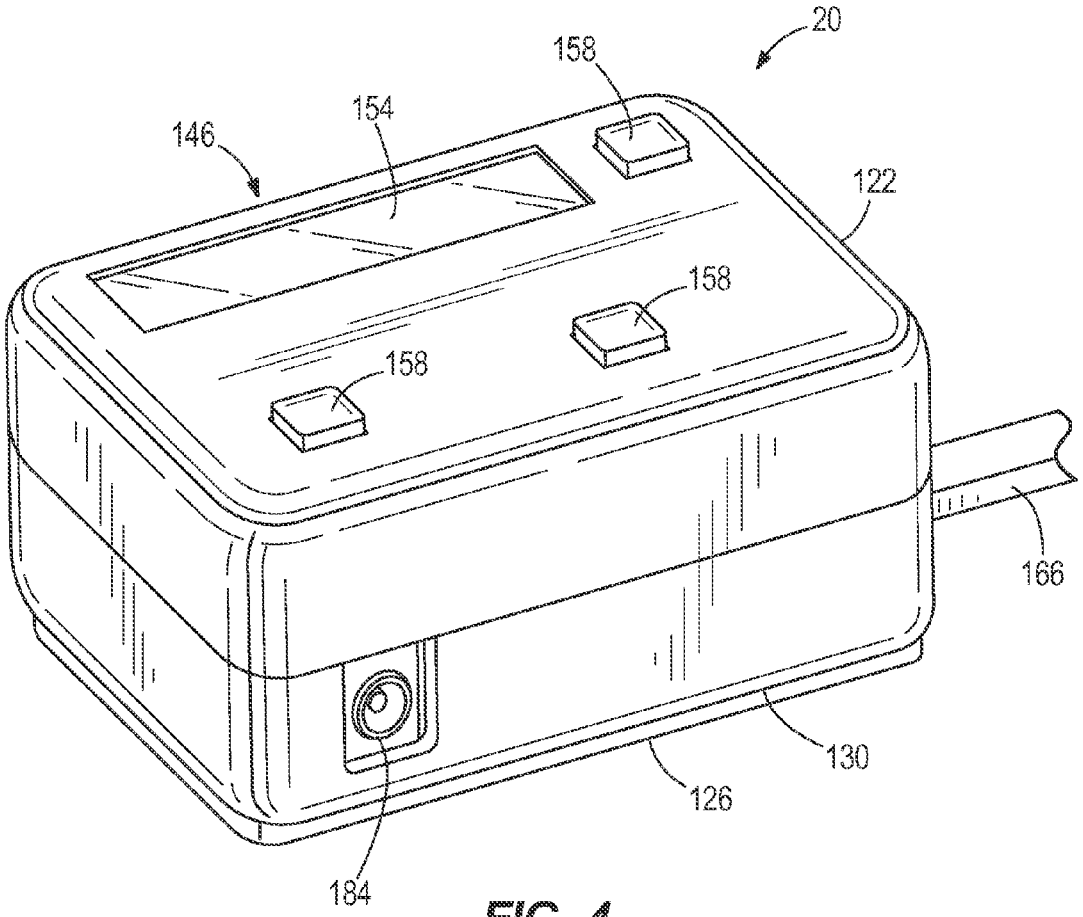
FIG. 4 is a perspective view of a control unit of the system of FIG. 1.
Figure 5:
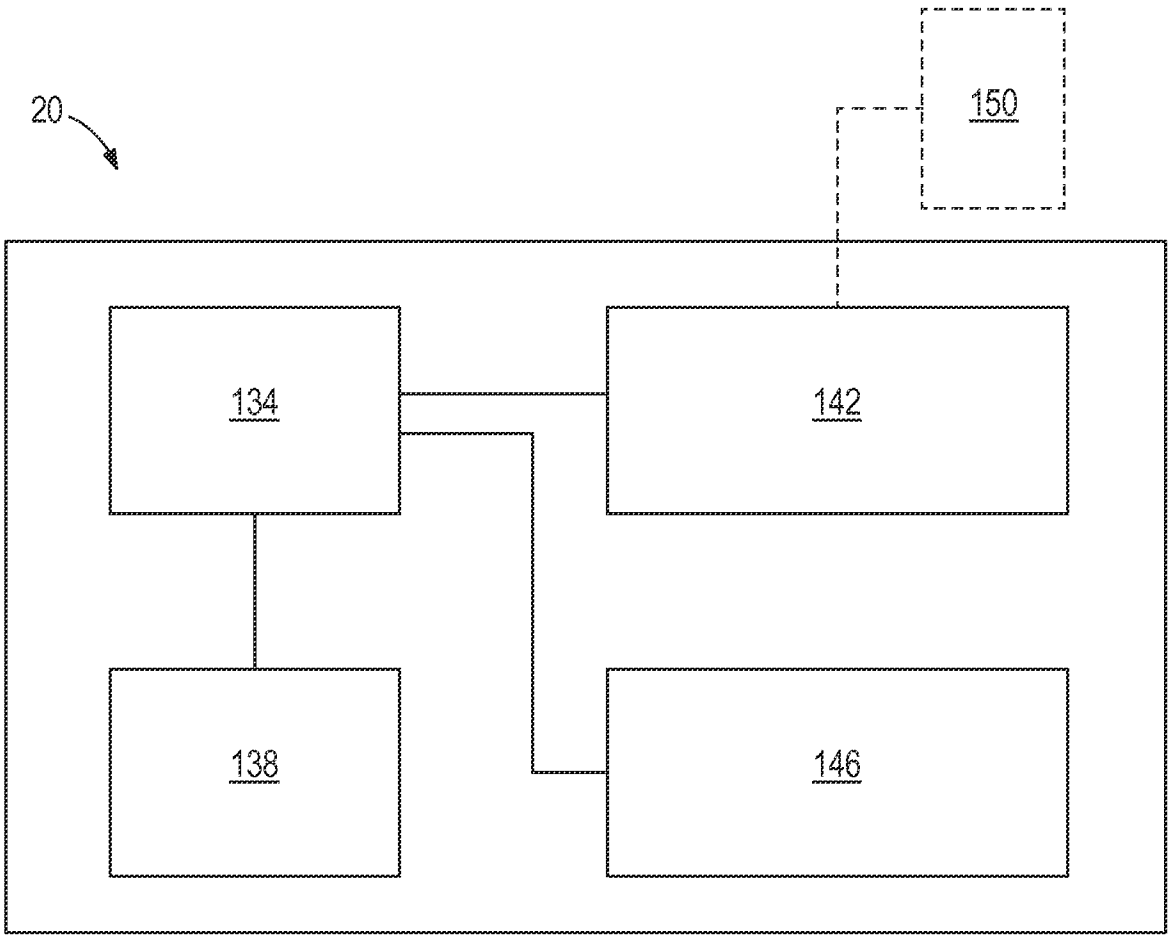
FIG. 5 is a schematic representation of the control unit of FIG. 4.

FIG. 4 illustrates the control unit 20 according to an embodiment of the system 10. The control unit 20 includes a housing 122 made of high-density polyethylene or other suitable polymer. The structure, components, and assembly of the housing 122 can take any of the forms and have any of the features described above in connection with the housing 34 of the light modules 30. A non-slip pad 126 is affixed to a bottom side 130 of the housing 122 in the illustrated embodiment to provide improved stability when the control unit 20 is positioned on a surface. Referring to FIG. 5, the control unit 20 further includes a controller 134 (e.g., a processor, set of discrete logic elements, and the like), in communication with memory 138, a communication interface 142, a user interface 146, and other associated electronics. In some embodiments, the control unit 20 can have additional input/output devices (e.g., I/O ports such as USB, SD, PS/2, serial ATA port, audio jack, external power ports, VGA, DVI, HDMI, and/or RCE ports for an external display, and the like). As described in detail below, a user or operator of the athletic pace signaling system 10 can interact with the controller 134 through the user interface 146 and/or the communication interface 142.

The memory 138 can be any suitable, non-transitory, computer-readable medium for storing data (i.e., information and/or instructions) that may be retrieved and/or executed by the controller 134. For example, the data can be stored on any readable medium (e.g., a magnetic disk, flash memory, an optical drive, etc.) either located within the housing 122 or within a portable device capable of communicating with the control unit 20.

With continued reference to FIG. 5, the communication interface 142 can allow the user to transmit data between the memory 138 of the control unit 20 and an external device 150, such as a computer, tablet, PDA, smart phone, remote, wearable electronic device, and the like functioning as a wireless or wired remote control as described above. The external device 150 can be particularly useful when the system 10 needs to be activated by the user being paced, in which case the user can carry the device while being paced or drop the external device at the beginning of use (i.e., at the beginning of a pace signaling operation). Accordingly, the external device 150 can be attached to, part of, or defined by any number of pieces of athletic and non-athletic equipment, such as sensor device (e.g., pressure, optical, and the like) on a swimmer's starting block or foot pad adapted to send a starting signal, an armband or wristband, and the like. In use of the pace signaling system in non-swimming applications as will be described in greater detail below, the external device 150 can be attached to, part of, or defined by other pieces of athletic and non-athletic equipment, such as a runner's starting block or foot pad with similar functionality to the swimmer's starting block or foot pad described above, a baton, a belt clip, an armband or wristband, a shoe or piece of apparel, and the like.

The communication interface 142 can include a data port, such as a USB, SD, or serial ATA port, as examples. The communication interface 142 can also or alternatively include a wireless module for sending/receiving data via Bluetooth®, NFC, wireless networking, or any other suitable wireless protocol.

Referring again to FIG. 4, the user interface 146 of the illustrated embodiment includes a display 154, such as a monochromatic display, a liquid crystal diode display, or other display that is capable of displaying alphanumeric data, and one or more keys or buttons 58. The user communicates with the controller 134 (FIG. 5) via the display 154 and the keys 158, which allow the user to make selections from the display 154. Each key 158 can correspond with different actions shown on the display screen 154, allowing the user to interact with the controller 134 to turn the controller 134 on/off, access the memory 138, etc. In some embodiments, these and other actions can be initiated by the external device 150 via the communication interface 142. Also, in other embodiments the user interface comprises one or more indicator lights or other elements suitable for communicating status and operation to a user (rather than a display as described above).

Referring again to FIG. 1, a control cable 162 connects the light modules 30 to the control unit 20. The control cable 162 can convey electric control signals and power (i.e., voltage and current) to each of the light modules 30 to control operation of the light modules 30, as discussed in greater detail below. In other embodiments, the control cable 162 conveys only electrical control signals, such as in cases where the light modules (e.g., each light module individually) are separately provided with power. In still other embodiments, the control cable 162 coveys only power, such as in cases where the control unit communicates wirelessly with the light modules (e.g., via wireless transmitter of the control unit 20 communicating with wireless receivers at the light modules 30).

In the illustrated embodiment, a primary cable section 166 of the control cable 162 extends from the control unit 20 to a first light module 30 of the plurality of light modules 30, and secondary cables 170 extend between adjacent light modules 30 in a series configuration. The primary and secondary cable sections 166, 170 can be of variable length or of a sufficient length to permit multiple spacing options from the control unit 20 to the first light module 30 and between adjacent light modules 30. The secondary cables 170 can be permanently fixed to the light modules 30, or removably fixed to the light modules 30 in order to facilitate disassembly of the system 10 for transporting or packaging, to add or remove individual light modules 30 from the system 10, or to replace individual light modules 30 or secondary cables 170 (e.g., replacing the secondary cables with longer or shorter secondary cables 170 for different spacings between light modules 30). In other embodiments, the control cable 162 can instead comprise multiple cables each extending from the control unit 20 to one of the respective light modules 30 in a parallel configuration. In such embodiments, each of the cables can have a different length to provide a desired spacing of the light modules 30. In still other embodiments, the control cable 162 can be a single, continuous cable having take-offs that connect to each of the respective light modules 30. Alternatively, the control cable 162 can be omitted and the light modules 30 can wirelessly communicate with the control unit 20 as mentioned above. The light modules 30 can be paired with the control unit 20 and communicate via Bluetooth®, near-field communication (NFC), wireless networking, or any other suitable wireless protocol.

With continued reference to FIG. 1, the control unit 20 is configured to receive power from a conventional AC power source via a power cable 180 connectable with a power port 184 on the control unit 20. However, in other embodiments, the control unit 20 can be battery-powered. In alternative embodiments, such as those in which the light modules 30 wirelessly communicate with the control unit 20, the light modules 30 can be battery-powered or can include individual power cables to receive power from a conventional AC power source.

Operation of the athletic pace signaling system 10 will now be described with reference to specific applications illustrated in FIGS. 6, 7 and 8. It should be understood that the illustrated applications are exemplary and should not be regarded as limiting.

Figure 6:
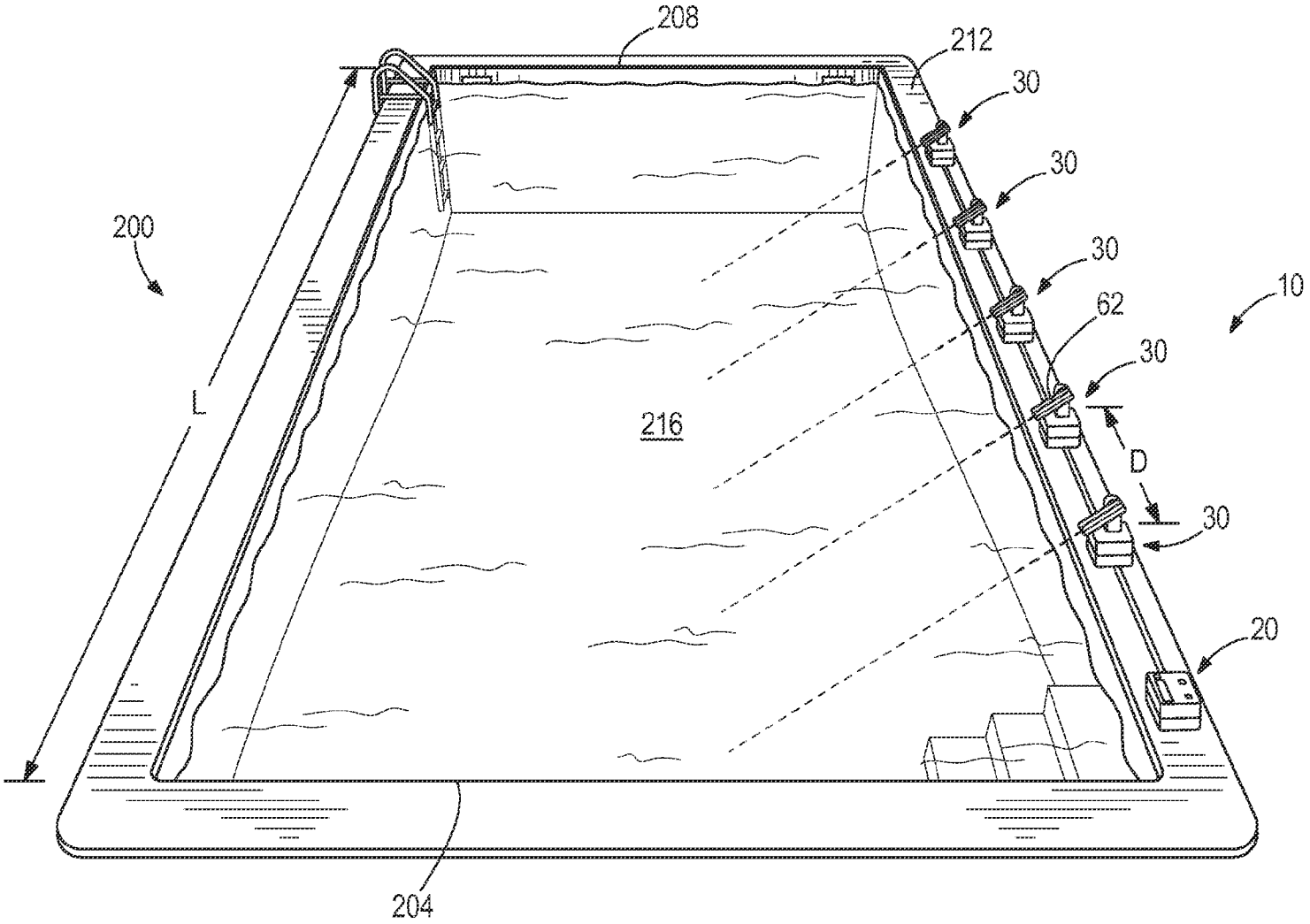
FIG. 6 is a perspective view of the system of FIG. 1 configured for use at a swimming pool.
Figure 7:
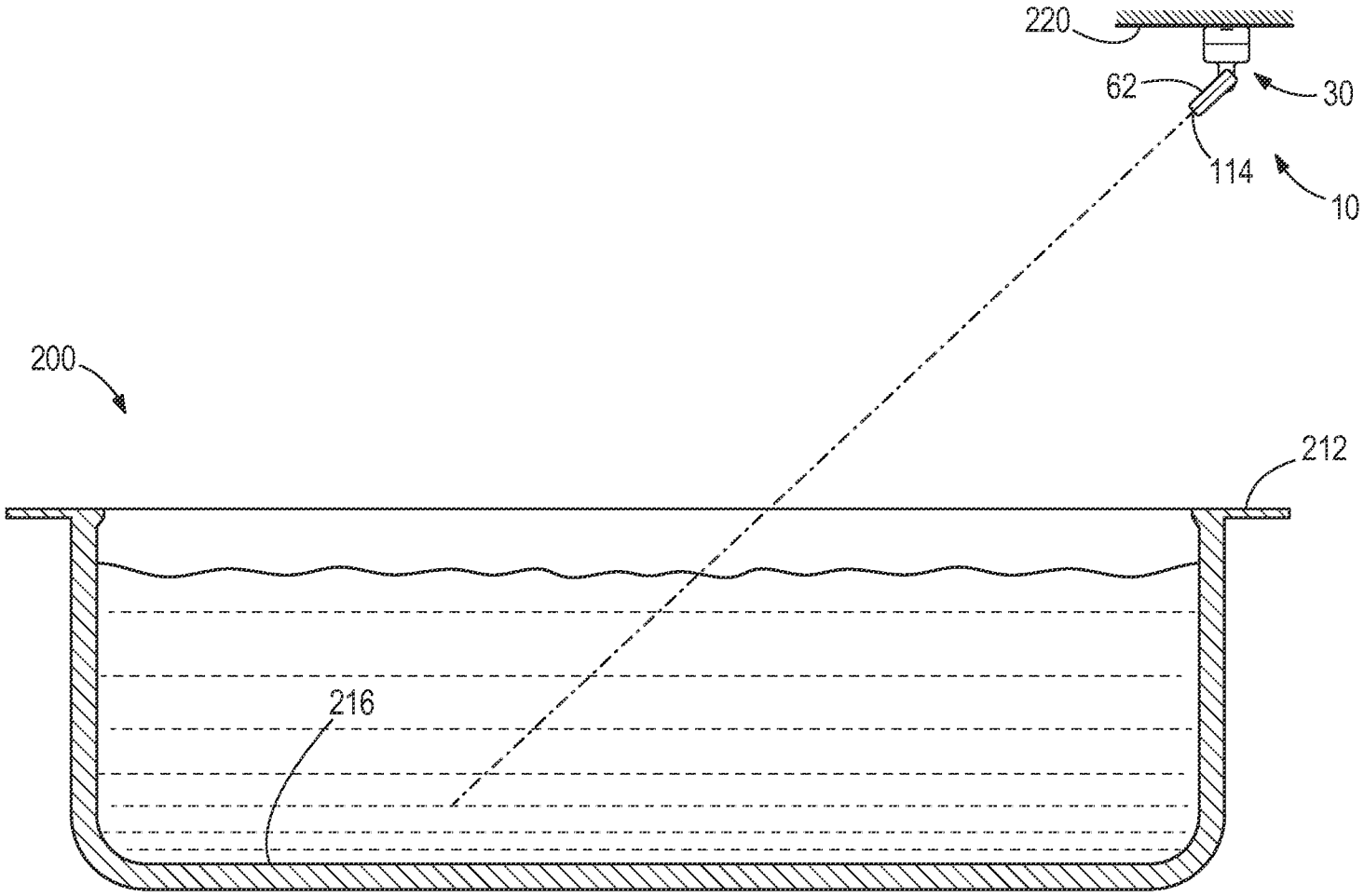
FIG. 7 is a side view of the system of FIG. 1 ceiling mounted for use at a swimming pool.

FIG. 6 illustrates the athletic pace signaling system 10 positioned adjacent a swimming pool 200. The swimming pool 200 includes a first end 204, a second end 208, and a length L between the ends 204, 208. The light modules 30 are removably positioned on a side 212 of the pool 200 and are arranged in a generally straight line along the length L of the pool 200. Adjacent light modules 30 are each spaced by a distance D that can be varied to accommodate pools 200 having a variety of different lengths L or to accommodate the training needs of the athlete. The number/spacing of light modules 30 can also be varied to alter the resolution of the system 10. The arm 62 of each module 30 can be pivotally adjusted such that the opening 114 (FIG. 2) is directed to a particular part of a side or bottom surface 216 of the pool 200. Alternatively, as shown in FIG. 7, portions of the signaling system 10, i.e., one or more of the light modules 30 (with or without the control unit 20) can be secured to the ceiling 220 above the pool 200 and the arm 62 of each module 30 adjusted as necessary to direct the opening 114 to a side or bottom surface 216 of the pool 200. In those embodiments not having an arm as described above, the light modules 30 can still otherwise be positioned and oriented to direct light from the modules 30 to desired positions on the side or bottom surface of the pool 200, or to any other positions adjacent the pool 200. In lieu of a ceiling mount, the relevant portions of the signaling system 10 can be positioned on the pool room or facility wall, or on a post or other structure in the vicinity of the pool 200 to elevate the modules 30 above the surface of the pool 200. In yet other embodiments, waterproof construction of the system 10 permits submersion of one or more components of the system in the pool 200 and/or coupling to the side or bottom surface 216.

In some embodiments, the athletic pace signaling system 10 is operable in a pace mode, an interval mode, or a competition mode. In other embodiments, any one or two of these modes are available. In the pace mode, the user (e.g., a swimmer) can input a customized, personal pace information into the memory 138 by using the user interface 146 or by using an external device 150 (e.g., a remote control with keypad) to upload the personal pace to the memory 138 via the communication interface 142 (FIGS. 4 and 5). The personal pace information can include various parameters, such as total distance (e.g., 100 meters), target finishing time (e.g., 53.5 seconds), number of laps (e.g., 2), pool length (e.g., 50 meters), and description (e.g., "100 m freestyle"). Alternatively, the user can select from one or more personal paces that were previously entered and stored within the memory 138 as described above. The personal pace can be constant over the total distance, or can be variable to account for turns, pacing strategy, fatigue, a finishing sprint, or other race and training parameters.

Once the personal pace is entered or selected, the user can interact with the user interface 146 or use an external device 150 to send a signal to the controller 134 in order to start a pace signaling operation. In some embodiments, the user can command the pace signaling system to begin the pace signaling operation by entering a start command or similar instructions via the user interface 146. In such embodiments, the controller 134 may insert a time delay between the time when the user starts the selected pace and when the controller 134 starts the pace signaling operation. The delay may act as a countdown, and the control unit 20 may include audio and/or visual indicators (e.g., flashing light and/or light having a particular color and/or displaying a particular image from one or more of the light modules 30, an indicator light on the control unit 20 and/or any of the light modules 30, and the like) to convey the countdown to the user. In this manner, the user can choose when the pacing starts and/or can otherwise coordinate the pacing to more properly coincide with an expected position within the pool 200. In those embodiments in which an external device (described above) is used to start a pace signaling operation, a time delay may not be necessary, but may still be used as desired.

With continued reference to the illustrated embodiments, when the pace signaling operation begins, the controller 134 can sequentially activate the light modules 30 to indicate the relative position of a virtual swimmer moving at the predetermined pace. When the virtual swimmer reaches a position along the length L of the pool 200 corresponding with the position of one of the light modules 30, the controller 134 activates the light module 30 to project a visible image onto the bottom 216 of the pool 200. For example, if the length L of the pool is 50 meters and the predetermined pace is one meter per second, a light module 30 positioned 10 meters from the first end 204 of the pool is activated 10 seconds after the start of the pace signaling operation, indicating the position of the virtual swimmer at that point in time. By viewing the visual image while swimming, the user can compare his current position with that of the virtual swimmer in order to determine if he is ahead of the predetermined pace, on the predetermined pace, or behind the predetermined pace.

The image projected by each light module 30 can consist of one or more points, lines, alphanumeric characters, shapes, or images representative of the selected pace. The image can include one or more words, numbers, or symbols for communicating information to the user, such as elapsed time, remaining time, laps completed, remaining laps, current distance, and remaining distance. The user may be able to customize the information displayed by the image as well as other aspects of the image by inputting such information and selections into the control unit 20 via the user interface 146 and/or by the communication interface 142.

Once activated, the respective light modules 30 can remain active for a predetermined time period to allow the user enough time to see and interpret the image. After the predetermined time period, the controller 134 can deactivate the light source 110, reduce the power to the light source 110 to gradually fade the image, change the image to a different color, etc. In some embodiments, the controller 134 can activate the respective light modules 30 to indicate the approach of the virtual swimmer by projecting a blinking image at a constant or varying rate, a progressively-intensifying image, a differently-colored image, and the like prior to the virtual swimmer reaching the positions of the respective light modules 30.

In some embodiments, multiple sets of light modules 30 can be connected with the control unit 20 for use with multiple swimming lanes simultaneously. Each set of lights 30 can be operated at or for the same predetermined pace, or one or more of the sets can be operated at a different pace. The light sources 110 of each set of modules 30 can, for example, project a different color light to facilitate differentiation between the lanes. Alternatively, the multiple sets of light modules 30 can also be used to indicate multiple different paces within the same swimming lane. In such embodiments, the light sources 110 of each set of modules 30 can, for example, project a different color light to facilitate differentiation between the paces.

In the interval operating mode of the athletic pace signaling system 10, the user can input a customized pace interval routine into the memory 138 by using the keys 158 on the user interface 146 or by using an external device 150 to upload the personal pace interval routine to the memory 138 via the communication interface 142. The pace interval routine can include multiple personal paces separated by rest periods or cool-down periods, if desired. For example, a pace interval routine can include 300 meters at a pace of 1.5 meters per second, followed by a two minute rest period, followed by 200 meters at a pace of 1 meter per second. Alternatively, the user can select from one or more pace interval routines that were previously entered and stored within the memory 138. Once the pace interval routine is entered or selected, the user can press a key 158 on the user interface 146 or use an external device 150 to send a signal to the controller 134 in order to start a pace signaling operation, as described above. During the pace signaling operation, the controller 134 can sequentially activate the light modules 30 to indicate the relative position of a virtual swimmer moving in accordance with the pace interval routine. As such, the user can compare his current position with that of the virtual swimmer in order to determine if he is ahead of the pace interval routine, on the pace interval routine, or behind the pace interval routine.

In the competition operating mode of the athletic pace signaling system 10, the user can upload historic pace information, such as collegiate, professional, Olympic, or world record paces for a particular athlete at a past athletic event, into the memory 138 via the communication interface 142. Such historic paces may be downloaded or obtained on external media through a third party or other vendor. In some embodiments, a collection of historic paces can be preloaded into the memory 138 before the athletic pace signaling system 10 is sold. Once the user selects a historic pace, the user can engage the user interface 146 or use an external device 150 to send a signal to the controller 134 in order to start a pace signaling operation, as described above. During the pace signaling operation, the controller 134 can sequentially activate the light modules 30 to indicate the relative position of a virtual swimmer moving at the historic pace selected by the user. As such, the user can compare his current position with that of the virtual swimmer in order to determine if he is ahead of the historic pace, on the historic pace, or behind the historic pace.

Figure 8:
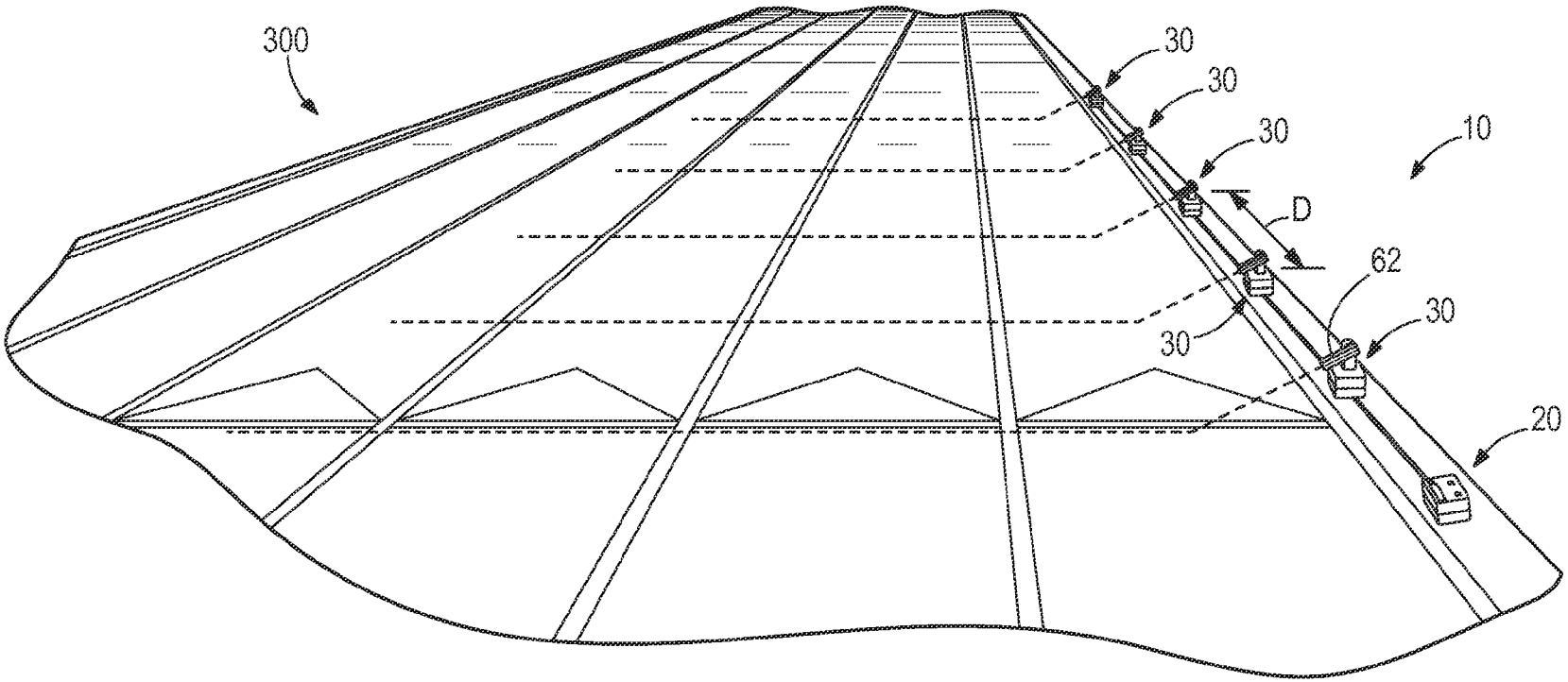
FIG. 8 is a perspective view of the system of FIG. 1 configured for use at a track.

FIG. 8 illustrates the athletic pace signaling system 10 positioned adjacent a running track 300. The system 10 can be positioned near a finish line of the track 300 to indicate the predetermined pace to the user at the end of a particular race or lap, however, the system 10 can be positioned anywhere along the track 300, over different lengths of track, or even over the entire track. For example, one or more of the light modules 30 can be secured to a post or other structure near the track 300 to elevate the modules 30 above the track surface, with the arm 62 of each module 30 adjusted as necessary to direct the opening 114 toward or to the side of the track surface. In those embodiments not having an arm as described above, the light modules 30 can still otherwise be positioned and oriented to direct light from the modules 30 to desired positions on or to the side of the track surface. Adjacent light modules 30 are spaced by a distance D that can be varied as described herein to accommodate the training needs of the athlete. The number/spacing of light modules 30 can also be varied to alter the resolution of the system 10.

As described above with reference to the swimming pool application, the illustrated athletic pace signaling system 10 can be operable in a pace mode, an interval mode, and/or a competition mode. In the pace mode, the user (e.g., a runner) can input customized, personal pace information into the memory 138 through the user interface 146 or by using an external device 150 to upload the personal pace to the memory 138 via the communication interface 142. Personal pace information can include various parameters, such as total distance (e.g., 800 meters), target finishing time (e.g., 135 seconds), number of laps (e.g., 2), track length (e.g., 400 meters), and description (e.g., "800 m"). Alternatively, the user can select from one or more personal paces that were previously entered and stored within the memory 138. The personal pace can be constant over the total distance, or can be variable to account for individual training needs, as previously described.

Once the personal pace is entered or selected, the user can interact with the user interface 146 or use an external device 150 to send a signal to the controller 134 in order to start a pace signaling operation. In some embodiments, the controller 134 may insert a time delay between the time when the user starts the selected pace and when the controller 134 starts the pace signaling operation. The delay may act as a countdown, and the control unit 20 may include audio and/or visual indicators to convey the countdown to the user. In this manner, the user can choose when the pacing starts and/or can otherwise coordinate the pacing to more properly coincide with an expected position on the track.

When the pace signaling operation begins, the controller 134 can sequentially activate the light modules 30 to indicate the relative position of a virtual runner moving at the predetermined pace. When the virtual runner reaches a position on the track corresponding with one of the light modules 30, the controller 134 activates the light module 30 to project a visible image on to the surface of the track. For example, the light modules 30 can be positioned to project the image on the same lane as the runner or in an adjacent lane. The user can compare his current position with that of the virtual runner in order to determine if he is ahead or behind the predetermined pace, as described above.

In some embodiments, multiple sets of light modules 30 can be connected with the control unit 20 for use with multiple running lanes simultaneously. Each set of lights 30 can be operated at the same predetermined pace, or one or more of the sets can be operated at a different pace. The light sources 110 of each set of modules 30 can project a different color light to facilitate differentiation between the lanes. Alternatively, the multiple sets of light modules 30 can also be used to indicate multiple different paces within the same running lane. In such embodiments, the light sources of each set of modules 30 can project a different color light to facilitate differentiation between the paces.

In the interval operating mode of the athletic pace signaling system 10, the user can input a customized pace interval routine into the memory 138 through the user interface 146 or by using an external device 150 to upload the personal pace interval routine to the memory 138 via the communication interface 142. The pace interval routine can include multiple personal paces separated by rest periods or cool-down periods, if desired. For example, a pace interval routine can include 400 meters at a pace of 6.0 meters per second, followed by a two minute rest period, followed by 200 meters at a pace of 5.5 meters per second. Alternatively, the user can select from one or more pace interval routines that were previously entered and stored within the memory 138 as described above. Once the pace interval routine is entered or selected, the user can press a key 158 on the user interface 146 or use an external device 150 to send a signal to the controller 134 in order to start a pace signaling operation, as described above. During the pace signaling operation, the controller 134 can sequentially activate the light modules 30 to indicate the relative position of a virtual runner moving in accordance with the pace interval routine. As such, the user can compare his current position with that of the virtual runner in order to determine if he is ahead of the pace interval routine, on the pace interval routine, or behind the pace interval routine.

In the competition operating mode of the athletic pace signaling system 10, the user can upload historic paces, such as collegiate, professional, Olympic, or world record paces for a particular athlete at a past athletic event, into the memory 138 via the communication interface 142. Once the user selects a historic pace, the user can, with the user interface 146 or an external device 150, send a signal to the controller 134 in order to start a pace signaling operation, as described above. During the pace signaling operation, the controller 134 can sequentially activate the light modules 30 to indicate the relative position of a virtual runner moving at the historic pace selected by the user. As such, the user can compare his current position with that of the virtual runner in order to determine if he is ahead of the historic pace, on the historic pace, or behind the historic pace.

While operation of the athletic pace signaling system 10 has been described above in connection with specific applications, it should be understood that the athletic pace signaling system 10 can be adapted for use with a diverse array of athletic activities. For example, in addition to a swimming pool 200 and a running track 300, the system 10 can be used to indicate an athletic pace on a skiing course, a speed skating rink, a cycling track, or any other athletic surface or environment associated with timed competition.

The system 10 can also be adapted to indicate a pace in the context of mechanized athletic activities, such as automobile racing. In such embodiments, it may be difficult for the user (e.g., a driver) to see an image projected onto the race track. Therefore, the light modules 30 can be elevated, positioned along one or more sides of the race track, and/or configured to emit bright flashes (or any other data previously described) visible to the user, e.g., on the track wall, to signal a desired pace. The system 10 is generally operable in the same manner described above, allowing the user to compare his current position with that of a virtual driver in order to determine if he is ahead of the pace, on the pace, or behind the pace.

Due to its modular construction, the system 10 can be implemented at existing athletic facilities without requiring substantial assembly/disassembly time. In addition, the system 10 can project images on to the athletic surface without requiring integration with or permanent fixture to the athletic surface. Also, the individual components of the system can be made waterproof or water-resistant to enable placement of any or all of the components of the system 10 underwater or in wet environments.

Although the invention has been described in detail with reference to certain preferred embodiments, variations and modifications exist within the scope and spirit of one or more claims of the invention as described.

The invention claimed is:

1. An athletic pace signaling system comprising:

a plurality of light generating modules, each light generating module including a housing, a support member extending from the housing, an arm pivotally coupled to the support member and defining a cavity having an opening, and a light generating source positioned to project a light through the opening; and a control unit couplable to the plurality of light generating modules, the control unit including a controller coupled to memory, a communication interface in communication with the memory, and a user interface in communication with the controller, wherein the controller is configured to store a predetermined pace and to cooperatively control the plurality of light generating modules to sequentially generate light representative of the predetermined pace.

2. The system of claim 1, wherein the support member is a telescoping support member.

3. The system of claim 1, wherein the light generating source is positioned within the arm.

4. The system of claim 1, wherein the light generating source is positioned within the housing.

5. The system of claim 1, wherein the light generating source is a laser generating source.

6. The system of claim 1, further including an external device for wirelessly communicating with the control unit.

7. The system of claim 6, wherein the external device is attached to or integrally formed with one of a swimmer's starting block or foot pad.

8. The system of claim 6, wherein the external device is attached to or integrally formed with one of a runner's starting block or foot pad.

9. The system of claim 6, wherein the external device is one of an armband, a wristband, a belt clip, and a shoe.

* * * * *